US005137302A

United States Patent [19]

Angel

[11] Patent Number: 5,137,302

[45] Date of Patent: Aug. 11, 1992

[54] ANALOG SLIDE DISPLAY

[76] Inventor: Henry R. Angel, 706 Burr St., Fairfield, Conn. 06430

[21] Appl. No.: 458,788

[22] Filed: Dec. 29, 1989

[51] Int. Cl.[5] ..... G06C 3/00; B12D 15/00

[52] U.S. Cl. ..... 283/65; 283/115; 235/88 N

[58] Field of Search ..... 283/65, 45, 115; 235/70, 88 R, 89, 88 N

[56] References Cited

U.S. PATENT DOCUMENTS 4,048,477 9/1977 Hungerford ..... 235/88 R
4,431,214 2/1984 Buffington ..... 283/65
4,580,814 4/1986 Berler ..... 283/65 X

*Primary Examiner*—Timothy V. Eley
*Assistant Examiner*—Willmon Fridie, Jr.
*Attorney, Agent, or Firm*—Dann, Dorfman, Herrell and Skillman

[57] ABSTRACT

A device for rapidly obtaining data related to destination points in the form of a navigational chart that supports a slide to move in a defined path relative to and beneath the display. A window is provided in the chart or along an edge thereof to enable a pointer on the slide to be visible through the useful range of movement of the slide. On the slide is provided at least one column of data, the individual lines of data being viewed sequentially through another window through the chart. Destination points are displayed on the navigational chart in their appropriate analog positions and connected by lines to the edge of the slot along which the pointer moves. The data is so coordinated with the pointer than when the point is opposite a line connected to a desired destination point, the proper data such as latitude and longitude and time delay codes for that destination point appear in the window as required in Loran and Global Position Satellite (GPS) systems.

11 Claims, 3 Drawing Sheets

28a

| | | | | | | |
|---|---|---|---|---|---|---|
| 40 53.64 | 73 44.20 | 26939.3 | 43944.4 | G 1 | | EXECUTION RKS |
| 40 54.71 | 73 38.18 | 26892.5 | 43945.3 | G 21 | | MATINICOCK PT |
| 40 58.28 | 73 38.78 | 26908.0 | 43979.2 | R 36 | | BLUEFISH SHL |
| 41 00.06 | 73 37.24 | 26900.4 | 43993.2 | R 2 | | GREENWICH HBR |
| 41 00.85 | 73 32.18 | 26860.0 | 43992.3 | G 1 | | STAMFORD HBR |
| 40 56.13 | 73 31.71 | 26842.4 | 43948.5 | G 17 | | OYSTER BAY |
| 40 54.30 | 73 30.42 | 26826.4 | 43929.9 | R 2A | | OYSTER BAY |
| 41 01.63 | 73 29.49 | 26839.6 | 43995.0 | R 30 | | SMITH REEF |
| 41 01.55 | 73 28.38 | 26839.4 | 44000.0 | R 28 | | LONG NECK PT |
| 40 58.34 | 73 23.66 | 26780.7 | 43956.1 | G 13 | | EATONS NECK |
| 41 02.45 | 73 25.52 | 26808.0 | 43996.2 | R 24B | | GREAT REEF |
| 41 05.35 | 73 19.47 | 26764.9 | 44011.6 | G 1 | | GEORGES RK |
| 41 07.27 | 73 17.13 | 26750.2 | 44024.5 | R 2 | | SOUTHPORT HBR |
| 41 06.50 | 73 15.20 | 26644.8 | 43970.5 | R 22 | | PINE CREEK PT |
| 41 06.99 | 73 13.27 | 26716.2 | 44015.6 | FL R 6S | | PENFIELD REEF |
| 41 08.26 | 73 13.05 | 26717.7 | 44026.2 | 2A | | BLACK RK HBR |
| 41 07.30 | 73 11.33 | 26700.3 | 44015.0 | R 2 | | BRIDGEPORT HBR |
| 41 06.30 | 73 11.73 | 26701.0 | 44007.1 | RW BW | | BRIDGEPORT HBR |
| 41 06.85 | 73 08.15 | 26671.6 | 44005.9 | R 18 | | POINT NO POINT |
| 41 07.83 | 73 07.53 | 26669.1 | 44013.2 | R 20 | | POINT NO POINT |
| 41 09.42 | 73 05.40 | 26654.3 | 44022.9 | G 1 | | HOUSATONIC RIV |
| 41 11.06 | 73 03.11 | 26638.4 | 44032.7 | R 16 | | CHARLES ISL |
| 41 11.96 | 73 02.27 | 26633.5 | 44038.7 | R 2 | | WELCHES PT |
| 41 13.29 | 72 54.63 | 26571.1 | 44036.8 | G 1 | | NEW HAVEN HBR |
| 41 12.53 | 72 51.85 | 26544.3 | 44025.7 | R 10A | | TOWNSEND LEDGE |
| 41 14.31 | 72 50.58 | 26538.1 | 44038.1 | R 34 | | COW & CALF |
| 41 14.45 | 72 49.98 | 26533.2 | 44038.3 | R 32 | | FIVE FOOT RK |
| 41 03.15 | 73 06.25 | 26645.1 | 43969.8 | R 2 | | MIDDLEGROUND |
| 41 13.81 | 72 46.27 | 26499.0 | 44026.7 | R 26 | | BROWNS REEF |
| 41 14.38 | 72 43.48 | 26476.0 | 44026.5 | R 22 | | GOOSE RK SHL |
| 41 14.38 | 72 41.10 | 26455.2 | 44022.1 | R 16 | | BACHEN HEAD |
| 41 15.02 | 72 39.22 | 26440.1 | 44024.3 | R 4 | | HALF ACRE RK |
| 41 12.86 | 72 37.41 | 26418.5 | 44003.9 | RG KR | | KIMBERLY REEF |
| 41 14.74 | 72 33.21 | 26386.4 | 44011.9 | R 10 | | MANHANASSET PT |
| 41 14.23 | 72 30.73 | 26363.6 | 44003.0 | R 8 | | KELSEY PT |

28b

| | | | | | | |
|---|---|---|---|---|---|---|
| 40 52.42 | 73 44.29 | 26936.4 | 43933.0 | R 44A | | SANDS PT |
| 40 55.64 | 73 42.13 | 26928.1 | 43959.9 | R 42 | | MAMARONECK HBR |
| 40 58.26 | 73 32.78 | 26857.5 | 43969.6 | R 32A | | MID SOUND |
| 41 00.49 | 73 35.99 | 26891.2 | 43995.2 | R 4 | | NEWFOUNDLAND RF |
| 41 00.35 | 73 31.44 | 26852.4 | 43986.6 | R 32 | | COVE (STAMFORD) |
| 40 57.86 | 73 29.29 | 26827.0 | 43960.5 | G 15 | | LLOYD PT |
| 41 01.83 | 73 30.45 | 26848.3 | 43998.3 | G 1 | | WESTCOTT COVE |
| 40 56.00 | 73 25.45 | 26789.4 | 43937.8 | R 8 | | HUNTINGTON BAY |
| 40 56.97 | 73 24.33 | 26782.6 | 43944.8 | G 1 | | EATONS NECK |
| 41 02.32 | 73 26.85 | 26818.9 | 43997.4 | R 26 | | GREENS LEDGE |
| 41 04.62 | 73 19.76 | 26765.2 | 44005.8 | R 24 | | COCKENOE ISLAND |
| 41 05.81 | 73 20.81 | 26777.6 | 44018.0 | G 3 | | SAUGATUCK RIV |
| 41 00.16 | 73 23.69 | 26786.1 | 43972.5 | R 24C | | CABLE & ANCHOR RF |
| 40 55.48 | 73 13.86 | 26689.9 | 43915.5 | RW NR | | NISSEQUOGUE RIV |
| 40 55.00 | 73 24.48 | 26778.5 | 43927.3 | G 1 | | NORTHPORT BAY |
| 40 56.32 | 73 09.91 | 26658.5 | 43917.0 | G 1 | | STONY BROOK HBR |
| 40 59.33 | 73 07.34 | 26644.3 | 43939.4 | G 11A | | OLD FIELD PT |
| 40 59.37 | 73 06.48 | 26637.1 | 43938.4 | RW PJ | | PT JEFFERSON |
| 40 59.31 | 73 04.81 | 26622.6 | 43935.3 | G 11A | | MT MISERY SHL |
| 41 12.32 | 73 03.01 | 26641.2 | 44043.1 | R 4 | | MILFORD HBR |
| 41 11.99 | 73 01.14 | 26623.7 | 44037.0 | R 12 | | POND PT SHL |
| 41 14.29 | 72 53.67 | 26565.2 | 44043.3 | R 2 | | MORGAN PT |
| 41 14.47 | 72 51.56 | 26547.1 | 44041.1 | G 1 | | EAST INDIES RK |
| 40 59.70 | 72 49.50 | 26491.8 | 43914.6 | G 7 | | NEGRO PT SHL |
| 41 14.08 | 72 48.12 | 26515.7 | 44031.6 | R 28 | | NEGRO HEADS |
| 41 00.20 | 72 42.30 | 26430.7 | 43908.0 | G 5 | | ROANOKE SHL |
| 41 14.32 | 72 42.35 | 26445.8 | 44023.8 | R 20 | | BACHEN HEAD |
| 41 12.12 | 72 40.50 | 26444.2 | 44003.0 | R 10G1 | | FALKNER ISL |
| 41 13.42 | 72 39.24 | 26437.5 | 44011.5 | G 15 | | FALKNER ISL |
| 41 14.83 | 72 37.44 | 26423.9 | 44019.8 | R 14 | | CHARLES REEF |
| 41 01.95 | 72 34.05 | 26362.6 | 43909.9 | G 3A | | MATTITUCK |

16

20

FIGURE 2

ANALOG SLIDE DISPLAY

The present invention relates to an analog slide display for rapidly obtaining information of a predetermined type about a subject pointed to on an analog display. For example, pointing to a destination point on a map or chart may provide direction on how to get there. More specifically, the present invention relates to such a device employing an analog display and a slide employing a selecting movement relative to the analog display enabling pointing to a selected subject to obtain needed information of a predetermined kind on the selected subject.

BACKGROUND OF THE INVENTION

Various types of slide tables have long been used as a means for looking up data, starting with subject matter in a table or list and providing information of a predetermined kind, usually in a digested form. Typically the data can be found by sliding a movable slide, or multiple slides, to a position dictated by a selected subject on the table to locate a narrow category of factual information in a window or to some other designated viewing position. Some typical examples of various contexts in which this type of table is used are:

1) locating data about bolt sizes, i.e., root diameter, holding strength, tap drill size, etc.;

2) finding the amount of calories related to different exercises and foods; and 3) motor data finder for electrical motor applications.

THE NATURE OF THE INVENTION

In accordance with the present invention, a slide table has been adapted in a unique and exceedingly useful way by moving a slide relative an analog display to locate facts pertaining to analog subjects actually pointed to. The analog display subjects may be destination points on a map or navigational chart or a picture, wherein certain types of information about parts of the analog subject can be displayed in a window or windows in the face of the analog display. For example, where the analog display is a map, various facts about the various cities on the map, such as population, hotel data, local industry, sports teams, etc., can be displayed. In this example, if all the available data available using the slide display were printed on the map it would obscure the analog picture of the map. To achieve the selection, a point on the analog display must be coordinated with a part of the slide, which generically may be referred to as a "pointer". The pointer may be arranged to move alternatively along the edge of the display or along a slot in the display, either of which is defined herein as a "window". Coordination may most easily be achieved by connecting each point or item on the display on which data is available to a unique point along an edge of a window through the map display; or at the edge of the display along which the pointer moves so that the data to appear in the window is coordinated with positioning the pointer next to a line connected to the subject of inquiry. Another example of an analog display is a picture of a machine in which the data about each part is viewed by moving the slide pointer of the display to the line connected to a selected part of the machine. Again, the amount of data available this way would obscure the picture if it were all printed on it.

Another application of the invention is the application of the chart to nautical or aviation charts where navigation data as used in "Loran" or Global Position Satellite (GPS) systems can be easily looked up by moving the slide to a position where the data is desired. For example, when plotting a navigation course from point to point, information about each navigation point (waypoint), it is necessary to look up data such as latitude and longitude, Time Delay codes (TD's) for the location and the proper name or marker code for the location. In Loran systems, either latitude or longitude or one or both of the two TD's are entered to define each way point, two entries being required GPS systems require latitude and longitude inputs. So much data printed on the chart in its digital form impedes the normal use of the chart and is confusing and difficult to find.

The primary advantage of the present invention is the ease of finding the subject and displaying the data. Finding the data can be done quickly and accurately. The user only needs to move the slide pointer opposite the line connector to the subject and the data is automatically lined up in the window or windows. With such ease of use, in navigation, for example, the device can be used from place to place along a boat's route, enabling the crew to quickly make course changes in a far easier way than the presently used look up tables in books.

The nature of the device inherently is inexpensive and compact, two attractive features for most potential users. Also, both sides of the device are useable thereby permitting twice the area of one side.

More specifically the present invention relates to an analog slide display for rapidly obtaining selected information about designated points on the display. The analog display has first and second viewing windows transverse to one another through the display and designated points connected to discrete positions along an edge of the first window. A slide member has at least a pointer member and a columnar listing of information about each designated point. Means holding the slide member beneath the display confines slide movement relative to the display only along a predetermined path, whereby the pointer moves along and is seen through the first viewing window in the display and the columnar listings appear sequentially in the second window. The relative arrangements on the slide and display are such that when the pointer is opposite the line to a selected designated point the proper listing for the point appears in the second window.

DRAWINGS OF PREFERRED EMBODIMENTS

For a better understanding of the present invention reference is made to the accompanying drawings in which FIG. 1 is a plan view from above of a nautical slide chart display according to the present invention in which the slide is confined to a linear movement;

FIG. 2 is a view of the slide for the slide chart of FIG. 1; and

DESCRIPTION OF THE EMBODIMENTS OF THE INVENTION SHOWN IN THE DRAWINGS

Figure 1:
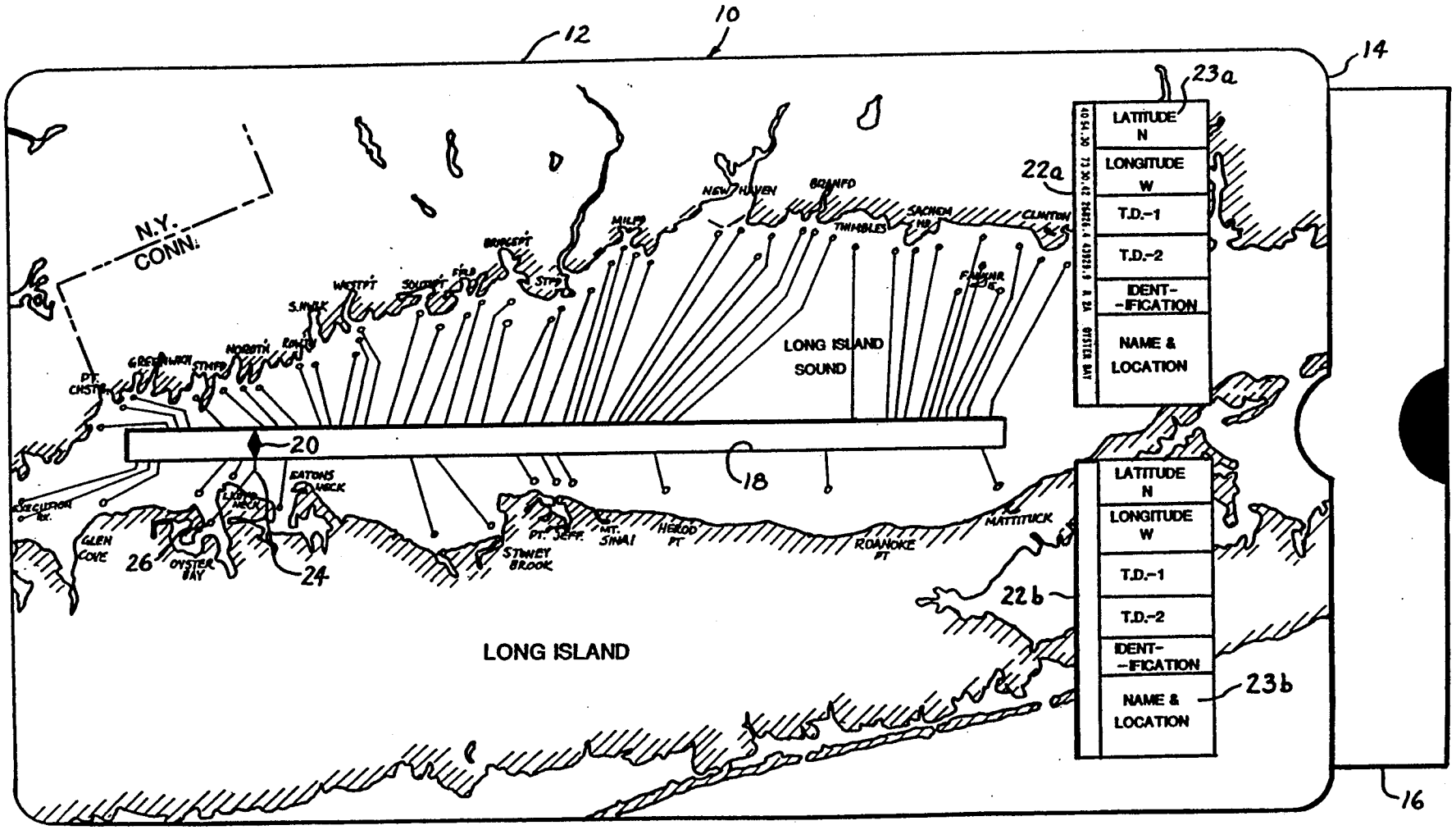

Referring first to FIGS. 1 and 2 there is illustrated a nautical slide chart providing an aid to navigation on parts of Long Island Sound. The analog chart 12 itself, as seen in FIG. 1, consists of the chart depiction printed or mounted on a cardboard, paperboard or plastic backer which is part of an enclosing envelope 10 open at one end 14 and into which slide 16 is received. The construction is such that the slide can move only linearly effectively in and out of the envelope. FIG. 2 shows the slide 16 removed from the envelope.

In this embodiment of the invention, the analog presentation is in the form of a map or chart which might be used by a person navigating a boat. In this analog presentation the name and location of an individual marker or buoy is shown. Each such location is, in turn, connected by a line to some point along the slot window 18 extending lengthwise and in a direction of relative movement of the slide 16 with respect to the chart 12. The slide 16 is provided with a pointer 20 which is positioned so that it may be seen as it moves along the entire length of the slot 18. A pair of aligned windows **22*a* and 22*b* extend through the supporting material for the chart 12 so that a portion of the slide 16 can be seen through them. What is viewed in this case through either window 22*a* or window 22*b*, and in this embodiment not through both, is information pertaining to the destination point which is connected by a line extending to an edge of the slot window beside which the pointer 20 is positioned. For example, in the illustration the pointer 20 is opposite a line 24 connected to a destination point 26 in Oyster Bay. This particular chart illustrates destination points on the opposite shores of Long Island and Connecticut along Long Island Sound. In window 22*a* appears a variety of information which is opposite a set of identifying labels 23*a*, which in this case are identical to those shown in 23*b***. The destination is shown to be "Oyster Bay" under the label "Name and Location". Under the label "Latitude N" is the latitude 40° 54.03'. "Latitude W" is then shown to be 73° 30.42'. TD-1 is shown as 26826.4 and TD-2 is shown as 43929.9, while identification is R 2A. For Loran input, either latitude or longitude or TD1 and TD2 data pieces may be used "GPS" systems require latitude and longitude.

The slide card illustrated in FIG. 2 provides two of information **28*a* and 28*b* which are somewhat staggered relative to one another. The individual lines of data have been positioned so that they will be seen through the respective slots in alternative positions of the pointer. Clearly the information is positioned in the column relative to the pointer so that when pointer 20 is at a particular line connecting it to a desired destination point, the information on that destination point will be in the window slot 22*a* or 22*b***.

In addition, the columns may have alternating colors for the information such as red and black and the connecting line may be in the same color so that by correlation of the colors there will be a further basis for being sure that the information displayed is correct. Another way of doing the same thing is to use one style of print for destinations connected by solid lines and another (e.g. italics) for destinations connected by a slashed line. However, placement of the lines is obviously in the discretion of the draftsman and making sufficient separation between adjacent lines of data is facilitated by keeping the connecting lines to the destination points sufficiently spaced from one another. Having the two windows for the similar types of data, but for different destination points, obviously allows more destination points to be represented on the slide card, but in a situation where more information is needed for a particular destination point, both windows **22*a* and 22*b* may be used for a single destination point and the labels 26*a* and 26*b*** may differ from one another to include other kinds of information.

It will be clear to those skilled in the art that it is also possible to put a chart on the opposite face of the envelope 10 with windows corresponding to 18, **22*a* and 22*b* and a pointer and destination point data on the opposite side of slide card 16**, thus providing two charts in the same space and cutting down on the number of chart pieces required to be carried.

It is also possible to provide other types of guide means instead of the envelope arrangement illustrated here. For example, channel means could be attached to the back of the paperboard backing of chart 12 to provide guide means for slide 16.

Figure 3:
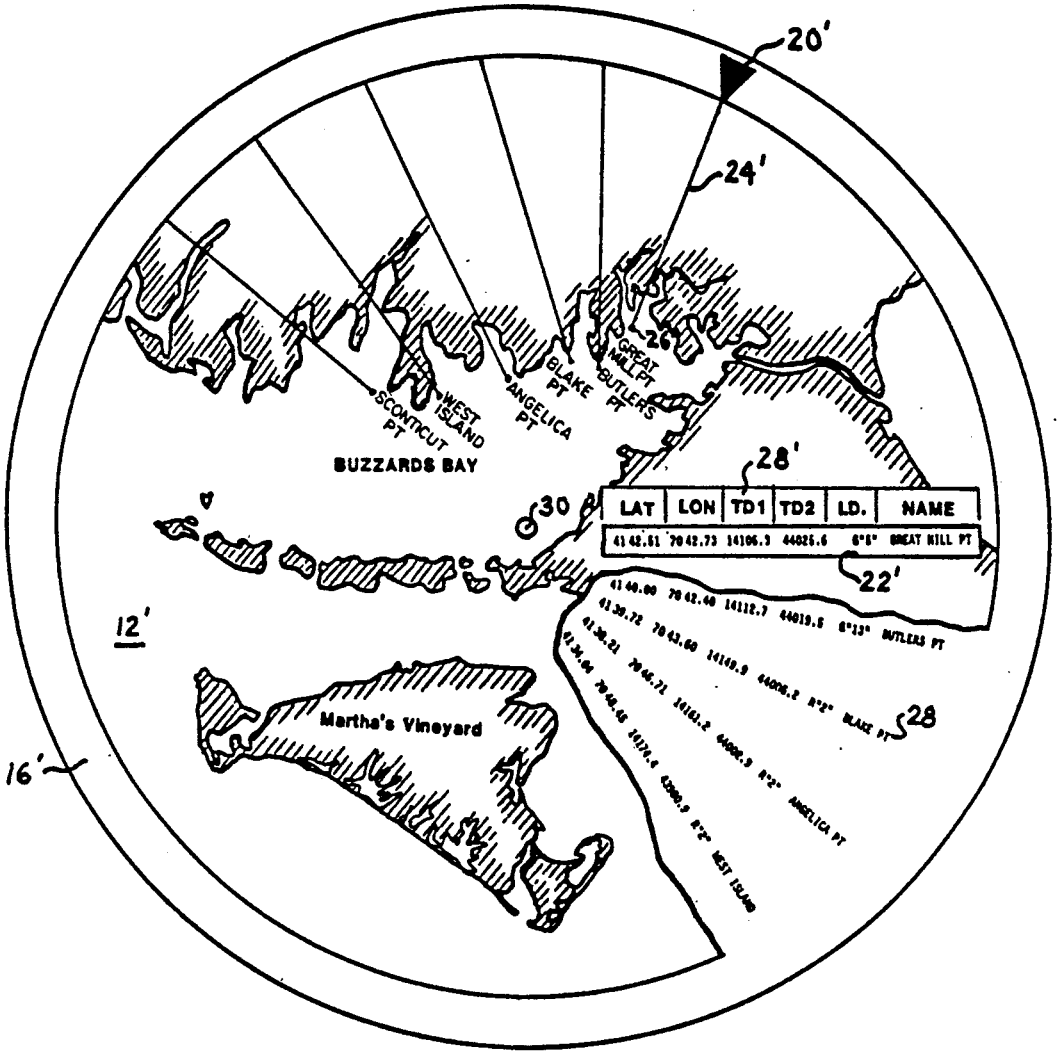
FIG. 3 is a view similar to FIG. 1 showing an alternative embodiment of a nautical slide chart employing rotational relative movement and partially broken away to display some of the arrangement of information sequentially displayed.

FIG. 3 shows an alternative type of analog chart employing a rotational rather than a linear mode of operation. It is shown in a circular configuration but the chart site need not be actually circular to be useful in a rotational mode. In this case the analog chart 12' is circular and maps the Buzzards Bay area. The slide 16' is not truly a slide, but a larger circular disc 16' fixed to the chart by a center rivet 30 which holds the two pieces together, but permits their relative rotation. In this drawing the chart is shown broken away to show the radially distributed information 28 on the "slide card" 16' which is sequentially moved to single slot 22' to display the information shown below identifying labels 28'. The information shown in window 22' corresponds to a selected destination point 26' connected by line 24' in this case to the edge of the circular chart 12'. Instead of a conventional slot or window the edges of slide 16' extends beyond the edge of chart 12' and the pointer 20' is located on the edge of the circular slide 16' in a peripheral window adjacent the edge of chart 12' to which lines 24' connected to selected destination points extend.

It will be apparent that a two chart configuration, as in the case of the FIGS. 1 and 2 type chart, is achieved by adding a third circular disc chart of the size of chart 12' to the stack and providing data on the opposite side of slide 16'

While navigational charts have been used by way of example to illustrate the present invention, it is very possible to use entirely different kinds of analog subject matter. With a line to a designated object or part being brought over to a position in the slot and the slide carrying information about that object or part then appearing in the information window, in some cases labeling is desirable particularly if the information is primarily numerical, but in other cases the information that appears in the window will be self-evident without having labels to designate its nature.

Various modifications of the invention will occur to those skilled in the art. All such modifications within the scope of the claims are intended to be within the scope and spirit of the present invention.

I claim:

1. A device for rapidly obtaining destination point information comprising:

a nautical chart giving the location of destination points and having at least two viewing windows transverse to one another through the chart;

a slide member having at least a pointer member and columnar listings of destination point information;

means holding the slide member beneath the chart and movable relative to the chart only along a path predetermined by the holding means, whereby the pointer moves along and is seen through one of the viewing windows and the columnar listings appear sequentially in a transverse window, the destination points being connected by a line on the chart to a point along the pointer window such that when the pointer is opposite the line and proper data appears in the transverse window.

2. The device of claim 1 in which the means holding the slide member beneath the chart confines slide movement to a linear direction.

3. The device of claim 2 in which a first window is transverse to the direction of slide movement and the second window is generally parallel thereto.

4. The device of claim 3 in which the slide member carries two columns of data lines and separate windows are provided for the respective columns of data.

5. The device of claim 4 in which the data in adjacent columns of the slide is staggered so that when data is displayed in one of the windows, it will not be displayed in the other window and vice versa.

6. The device of claim 3 in which a second similar chart is provided back to back to the first with the slide member between them movable relative to both and printed on opposite slides with pointers for one of the windows and data for the other window of each of the charts.

7. The device of claim 6 in which the charts are provided on opposite sides of an envelope closed along at least two edges to guide and direct the slide in the linear direction and open at least one end to permit the slide to move in and out of the envelope and assume various positions as required to use the device.

8. The device of claim 1 in which the slide is supported to move rotationally relative to the chart.

9. The device of claim 8 in which the chart is circular and the slide is attached thereto at the center of the chart by means permitting relative rotation.

10. The device of claim 9 in which the slide is circular and has a larger diameter than the chart in order to provided one window along the circular edge of the chart and is provided with a pointer which moves along the edge of the chart and the chart is provided with at least one slot window through which data is displayed.

11. The device of claim 1 for use in Loran or Global Position Satellite (GPS) navigation in which the data appearing in the transverse --window-- is at least two pieces of input data selected from latitude, longitude and one or more time delay codes, two of which data input pieces are used as input for a Loran or GPS system.

* * * * *

UNITED STATES PATENT AND TRADEMARK OFFICE

CERTIFICATE OF CORRECTION

PATENT NO. : 5,137,302

DATED : August 11, 1992

INVENTOR(S) : HENRY R. ANGEL

It is certified that error appears in the above-identified patent and that said Letters Patent is hereby corrected as shown below:

Column 3, line 40, after "used" insert a period (.);
line 42, after "two" insert --columns--.

Claim 1, Column 5, line 7, "and" should read --the--.

Claim 6, Column 5, line 26 (last line), "slides" should read --sides--.

Signed and Sealed this

Twelfth Day of October, 1993

*Attest:*

Bruce Lehman

BRUCE LEHMAN

*Attesting Officer*

*Commissioner of Patents and Trademarks*